US011051627B2

(12) United States Patent
Faouen et al.

(10) Patent No.: US 11,051,627 B2
(45) Date of Patent: Jul. 6, 2021

(54) ANTERIOR SUPPORT DEVICE FOR THE LOWER LIMBS

(71) Applicant: Mobiiuz, Villeurbanne (FR)

(72) Inventors: Patrick Faouen, Caluire et Cuire (FR); Léon Rubinstein, Oullins (FR)

(73) Assignee: Mobiiuz, Villeurbanne (FR)

( * ) Notice: Subject to any disclaimer, the term of this patent is extended or adjusted under 35 U.S.C. 154(b) by 0 days.

(21) Appl. No.: 16/431,413

(22) Filed: Jun. 4, 2019

(65) Prior Publication Data

US 2019/0350371 A1 Nov. 21, 2019

Related U.S. Application Data

(63) Continuation-in-part of application No. PCT/FR2017/000225, filed on Dec. 1, 2017.

(30) Foreign Application Priority Data

Dec. 5, 2016 (FR) ..... 16 01728

(51) Int. Cl.

| | |
|---|---|
| ***A47C 16/02*** | (2006.01) |
| ***A47C 16/04*** | (2006.01) |
| ***A61G 5/14*** | (2006.01) |
| ***A61G 5/12*** | (2006.01) |

(52) U.S. Cl.

CPC ..... *A47C 16/025* (2013.01); *A47C 16/04* (2013.01); *A61G 5/127* (2016.11); *A61G 5/14* (2013.01)

(58) Field of Classification Search

CPC ..... A61G 5/127; A61G 5/14; A47C 16/025; A47C 16/02; A47C 16/04; A47C 9/025; A47C 9/005; A47C 7/503; A47C 7/506

USPC ..... 297/423.11, 423.16

See application file for complete search history.

(56) References Cited

FOREIGN PATENT DOCUMENTS

| | | | | |
|---|---|---|---|---|
| CN | 201 182 386 | Y | 1/2009 | |
| EP | 0252274 | A2 * | 1/1988 | ..... A47B 83/02 |
| FR | 364 211 | A | 8/1906 | |
| FR | 2 931 646 | A1 | 12/2009 | |
| FR | 3 020 750 | A1 | 11/2015 | |
| FR | 3022443 | A1 * | 12/2015 | ..... A47C 9/025 |

(Continued)

OTHER PUBLICATIONS

International Search Report and Written Opinion dated Feb. 7, 2018 for PCT/FR2017/000225 filed Dec. 1, 2017 with English Language Translation of same.

*Primary Examiner* — Milton Nelson, Jr.
(74) *Attorney, Agent, or Firm* — Williams Mullen; F. Michael Sajovec

(57) ABSTRACT

The invention relates to the field of ergonomic furniture. The device (1) comprises an upper support element (8) for supporting the thighs and a lower support element (9) for supporting the legs or tibias, that can be separated by an open space (11) or recess for the knees. An assembly (7) formed by the two support elements (8, 9) is mounted so that it pivots around a horizontal axis (A) on a bearing structure (2, 6), wherein rotation of the assembly (7) enables the support elements (8, 9) to accompany the lower limbs of a user during a transition from one use position to another. The device (1) is incorporated into an apparatus for maintaining a standing or sitting-standing position, having at least one footrest (4, 5). The device is applicable to the arrangement of a workstation, such as a computer workstation or an industrial workstation.

27 Claims, 9 Drawing Sheets

(56) References Cited

FOREIGN PATENT DOCUMENTS

| | | | |
|---|---|---|---|
| GB | 2176396 | A | 12/1986 |
| NO | 166 163 | B | 3/1991 |

* cited by examiner

ANTERIOR SUPPORT DEVICE FOR THE LOWER LIMBS

CROSS-REFERENCE TO RELATED APPLICATIONS

This application is a Continuation-in-Part of International Application No. PCT/FR2017/000225 filed 1 Dec. 2017, now published as WO 2018/104595 A1 on 14 Jun. 2018, which claims priority to French Patent Application No. 16-01728 filed 5 Dec. 2016, the full disclosures of which are incorporated herein in their entireties by reference.

TECHNICAL FIELD

The present invention generally concerns the field of ergonomic furniture. More specifically, it concerns an anterior support device for the lower limbs of a person designated as the "user," as well as a body support apparatus provided with such an anterior support device for the lower limbs, this support device and this support apparatus being especially suitable for a standing or sitting-standing position of their user, said device and apparatus being themselves possibly associated, when in use, with a desk or workstation, such as a computer or industrial workstation.

BACKGROUND

At present, working while standing or with an approximately straight posture, referred to as a "sitting-standing" position, has made headway compared to the traditional seated position. More natural, the standing position stimulates awareness and increases energy expenditure while avoiding fatigue and back pain.

For forward leaning standing or even backward leaning positions, the use of support devices for the human body is desirable. In a manner that is generally known, body support devices have one or more anterior or posterior support elements that, depending on the height at which they are installed, can be applied to various parts of the human body, such as the torso, the back, the abdomen, or the lower limbs. Moreover, some of these known support devices have, in their upper portion, support elements for the elbows or forearms and, in their lower portion, footrest platforms.

When making autonomous body support devices, the anterior and/or posterior support element(s) are customarily mounted on a single or double support column rising above a base that rests on the floor and provides the necessary stability for the support device itself and its user.

Anterior support devices for the lower limbs are typically found as simple stuffed panels, held in a stationary position in a substantially vertical plane. Depending on the height at which they are placed, these panels accommodate either the front of the thighs or the front of the legs, in other words, the region of the tibias of a person who will be maintained in a standing position with some support. Thus, Japanese patent application JP 2008-012169 A discloses a body support against which a person standing at a workstation may apply their thighs, while U.S. Pat. No. 5,149,174 A discloses an anterior support device for the legs or the tibias of a person who is standing or sitting-standing.

French patent application FR 3020750 A1, filed by the Applicant, discloses, in particular, within FIGS. 16 and 17 of that application, body supports allowing for two distinct postures, namely a forward leaning standing position and a backward leaning standing position, through the combination of several support elements or surfaces "suspended" from a bearing structure having a center support column and a base with a dual-position footrest, respectively anterior and posterior, these body supports also providing easy lateral access. Here, the support elements comprise, on the one hand, an upper anterior support element for the torso and, on the other hand, a lower anterior support element for the lower limbs. The latter support element, primarily intended for use by the thighs, can be realized in two symmetrical and independent parts, respectively intended to accommodate the left thigh and the right thigh; it can, moreover, be combined with a posterior support element. Additionally, the base with the dual footrest can assume an "H" shape, as shown in FIGS. 11 to 13 of the aforementioned document.

With respect to this known body support, the transition from one use position to another, for example, from the forward leaning position with support from the posterior footrest to the rear leaning position with support from the anterior footrest, can only be accomplished with a temporary loss of contact by the user with the existing support surfaces, sometimes obligating the user to make adjustments.

Moreover, the "suspended" assembly of the anterior support element for the lower limbs, an assembly that makes use of flexible connectors, creates an instability that is itself the cause of a lack of control of user movement during the transition from one use position to another.

In light of the above findings, the present invention aims to avoid the drawbacks and inadequacies of the body support referred to by providing an improvement that enables the user to change positions without losing contact with the support surfaces, while preserving and even enhancing effectiveness, comfort, mobility, and accessibility.

SUMMARY

To that end, the primary object of the invention is an anterior support device for supporting the lower limbs of a user during a standing or sitting-standing position, said device comprising:

an upper support element for supporting the front of the thighs, substantially extending in a transverse plane, a lower support element for supporting the front of the legs or tibias, substantially extending in a transverse plane, wherein an assembly formed by the upper support element and the lower support element is mounted so that it pivots on a bearing structure, stationary or movable, around a transversely oriented horizontal pivot axis; and wherein rotation of said assembly around the horizontal pivot axis enables the upper support element and the lower support element to accompany the lower limbs of the user during the user's transition from a first use position to a second use position.

In the case of an anterior support device, it has a support element against which the user presses the front of his thighs and another support element located below it, against which the user simultaneously presses the front of his legs, the assembly formed by these two superposed support elements being capable of pivoting around a transversely oriented horizontal axis.

In one embodiment of the invention, an obtuse angle is formed between the plane of the upper support element and the plane of the lower support element. The obtuse angle formed between the plane of the upper support element and the plane of the lower support element can have a fixed value.

However, this obtuse angle, formed between the plane of the upper support element and the plane of the lower support element, can also have an adjustable value.

The value of this obtuse angle, formed between the plane of the upper support element and the plane of the lower support element, is advantageously comprised between 130° and 150°.

In this case, the apex of the obtuse angle formed between the plane of the upper support element and the plane of the lower support element, is beneficially situated in front of the horizontal axis around which is pivotally mounted the assembly formed by the two support elements, respectively upper and lower.

In another embodiment of the invention, it is provided that in the said assembly, at least one of the two support elements, respectively upper and lower, is pivotally mounted around an additional transversely oriented horizontal pivot axis, so as to accompany, by rotation of said assembly around its own horizontal pivot axis and/or by rotation of one support element such as the lower support element relative to the other support element such as the upper support element, the lower limbs of the user during the user's transition from a first use position to a second use position.

In this embodiment, the additional horizontal pivot axis may be associated with the lower support element and may be situated at an intermediate height of said lower support element.

Between the upper support element and the lower support element, at least one open space or recess suitable for accommodating the user's knees can be provided.

The assembly formed by the two support elements, respectively upper and lower, may be mounted on a stationary bearing structure so that it pivots around a transversely oriented horizontal axis that is situated near the open space or recess present between the upper support element and the lower support element, or substantially near the junction between the upper support element and the lower support element if said open space or recess is not provided.

In a variant of the above, the assembly formed by the two support elements, respectively upper and lower, is mounted on a stationary bearing structure so that it pivots around a transversely oriented horizontal axis that is situated at an intermediate height of the upper support element or near the apex of this upper support element.

In another variant, the assembly formed by the two support elements, respectively upper and lower, is pivotally mounted on a bearing structure that is itself movable, in particular, a pivoting structure having at least one articulation along a transversely oriented horizontal axis. The movable bearing structure consists, in particular, of a support arm pivotally mounted in an anteroposterior plane, an extremity of said support arm being connected by articulation to a base and the other extremity of this support arm being connected by articulation to the assembly formed by the two support elements, respectively upper and lower, said support arm occupying a first angular position for the first use position and occupying another angular position for the second use position.

In all cases, the upper support element and the lower support element can be made from a semi-rigid material, in particular, in the manner of a shell. These support elements can also be made of a flexible or deforming material, in particular, similar to webbing or straps.

The upper support element and the lower support element can each be shared by the user's left lower limb and the user's right lower limb. According to an alternative possibility, the upper support element and/or the lower support element have a left portion and right portion that are dissociated, respectively assigned to the user's left lower limb and to the user's right lower limb, thereby providing some independence from the supports for the left lower limb and the right lower limb.

The device can also comprise one or more stops capable of limiting the pivoting of the assembly formed by the two support elements, respectively upper and lower. In a variant or addition to such stops, the assembly formed by the two support elements, respectively upper and lower, can also be provided with anti-return and/or automatic means for locking this assembly in at least one predetermined angular position, in which case a manual unlock will be provided.

Advantageously, this device also has return means, such as a spring, capable of returning the assembly formed by the two support elements, respectively upper and lower, by pivoting to an intermediate or neutral position, in particular, to a position in which said assembly is approximately located in a vertical plane.

Another object of the invention is a complete apparatus for supporting body of a user in a standing or sitting-standing position, said apparatus comprising:

an anterior support device for the lower limbs, comprising an upper support element for supporting the front of the thighs and a lower support element for supporting the front of the legs or tibias; and a bearing structure having at least one footrest, wherein an assembly formed by the upper support element and the lower support element is mounted so that it pivots on the bearing structure around a transversely oriented pivot axis.

Said apparatus preferably also has at least one of an anterior support element and a posterior support element for supporting the user's torso.

In the case of a posterior support element for the user's torso, this additional support element can be connected and, especially, suspended from the upper portion of the assembly formed by the two support elements, respectively upper and lower, of the anterior support device for the lower limbs, which avoids the need for any additional support.

In the case of an anterior support element, possibly removable, for the user's torso, this additional support element is advantageously supported by the assembly formed by the two support elements, respectively upper and lower, of the anterior support device for the lower limbs, said additional support element thereby being situated in the upward extension of the upper support element for the thighs.

Similarly to the above, the assembly formed by the two support elements, respectively upper and lower, of the anterior support device for the lower limbs can be extended downward, below its lower support element for the legs or the tibias, the extension thus constituted supporting at least one footrest at its lower extremity.

An additional posterior support element for the user's torso can also be borne by a separate support structure, which is itself stationary or movable.

The assembly formed by the two support elements, respectively upper and lower, of the anterior support device for the lower limbs can be pivotally mounted around a horizontal axis between two lateral support legs rising above a base with footrest, in which case the additional support element for the torso can also be mounted between the two support legs.

In another configuration, the assembly formed by the two support elements, respectively upper and lower, of the anterior support device for the lower limbs is pivotally mounted around a horizontal axis on a center support column rising above a base with a footrest, said assembly also being capable of being pivotally mounted around the vertical axis of the center support column.

The footrest can be a dual footrest, with separate anterior and posterior footrests at opposite angles, the anterior footrest and posterior footrest being respectively associated with the two use positions.

In a variant, the apparatus has a single footrest, such as posterior footrest, with a double or triple slope, with an anterior portion at a smaller angle and a posterior portion at a greater angle, the anterior portion and the posterior portion of this single footrest being respectively employed for the two use positions.

In all cases, the anterior support device incorporated in such an apparatus can follow the user's lower limbs during a change of position and, in particular, during the transition:

from a first standing use position leaning forward, with the user's feet resting on the posterior footrest or on the posterior portion of the single footrest, to a second standing use position leaning backward or standing upright, with the user's feet resting on the anterior footrest or on the anterior portion of the single footrest, or vice versa, that is, during the opposite transition from the second use position to the first use position.

Overall, the anterior support device and the body support apparatus, objects of the invention, have one or more of the following advantages, especially in relation to their use:

Continuous accompaniment of the movement of the user's lower limbs during each transition from one posture to another, with continuous support for the body in all intermediate positions;

Consistent movement, designed for the perfectly controlled transition from one use position to another;

The device is suitable for accompanying the user's lower limbs between any use positions, i.e. not only extreme positions but also any intermediate positions;

"Automatic" operation requiring no controls or adjustment, and whose safety is provided by the stops limiting movement or by the automatic locking means;

In light of the above, a more "fluid" and more natural, and therefore easier and potentially faster, transition from one use position to another, with an enhanced feeling of safety;

Optimum distribution of pressure forces through the simultaneous pressure of the thighs and legs, thereby resulting in improved comfort for the user and relief of the muscular effort needed to maintain postures;

In the case of an open space or recess arranged between the upper support element and the lower support element, a freeing of the area occupied by the knees, which thereby lodge in this open space or recess, thereby avoiding any contact, resulting in an additional improvement of user comfort, especially during prolonged use;

The ability to maintain a suitable, constant angle between the thighs and the legs;

"Locking" of the lower limbs through simultaneous contact of the thighs with the upper support element and of the legs with the lower support element, and, where appropriate, positioning of the knees in the open space or recess situated between the upper support element and lower support element, which eliminates any risk of slippage regardless of the pressure exerted, and which thus promotes the feeling of stability;

Mechanically balanced and stable device;

Lateral or rear access is not affected by the presence of this device.

In the above description, as in the detailed description that follows, the terms or expressions relating to a position or orientation such as "upper," "lower," "in front of," "in back of," "anterior," "posterior," "transversal," or "vertical" refer to the device or apparatus in its configuration of use as well as to the normally positioned user.

BRIEF DESCRIPTION OF DRAWINGS

A better understanding of the invention will be obtained, and other characteristics and advantages made clear, from the following description, which refers to the schematic drawings attached, representing, by way of example, several embodiments of this anterior support device for the lower limbs and the body support assembly equipped with such a support device.

In these drawings.

DETAILED DESCRIPTION

Figure 1:
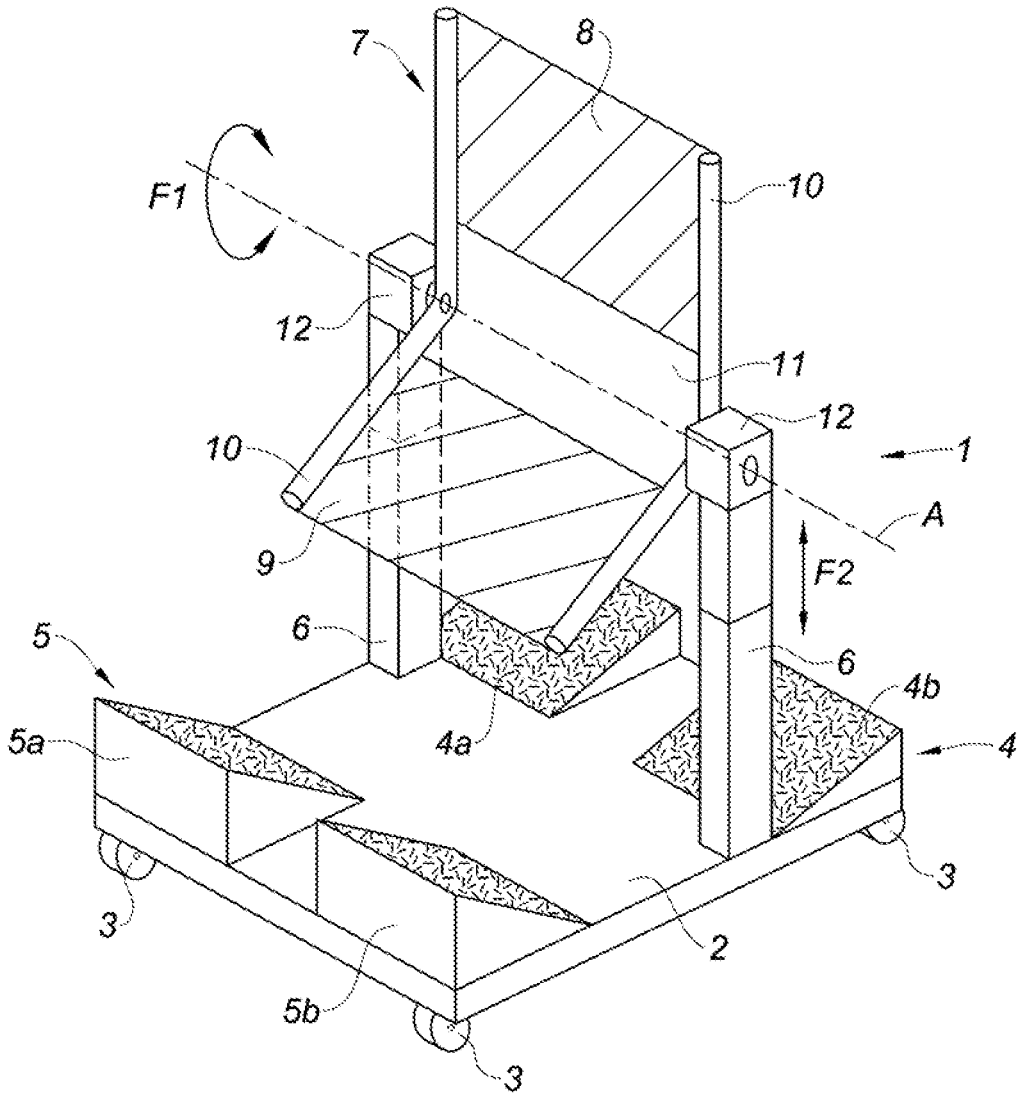
FIG. 1 is a perspective view of an anterior support device according to the invention, in a first embodiment.
Figure 2:
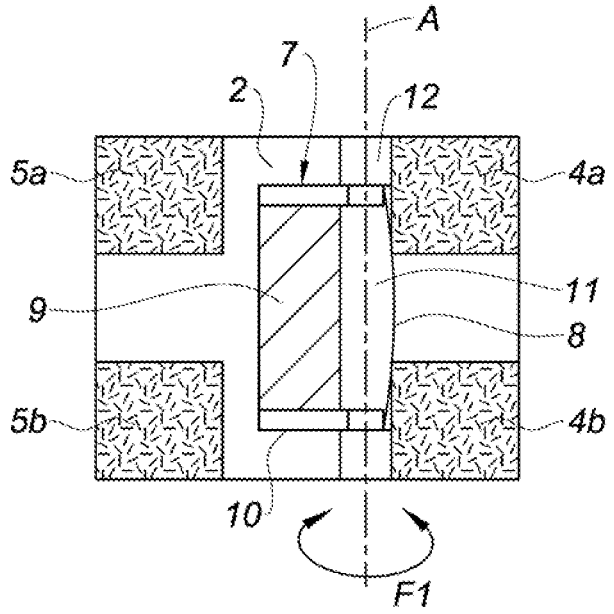
FIG. 2 is a plan view from above of the device of FIG. 1.

We first refer to FIGS. 1 to 5 relative to a first embodiment.

The anterior support device for the lower limbs, referred to overall as 1, is part of a complete apparatus for maintaining the body in a standing or sitting-standing position.

This apparatus comprises a base 2, of generally rectangular shape in the example shown. Base 2 is here provided with four rollers 3 for movement on the floor, rollers 3 being however optional. This base 2 is equipped with a dual footrest, with anterior footrest 4, here consisting of two inclined platforms 4*a* and 4*b*, respectively left and right, and posterior footrest 5, here consisting of two other platforms 5*a* and 5*b*, respectively left and right, whose inclination to the horizontal is opposite and greater than that of platforms 4*a* and 4*b*. The separation between the two platforms 4*a* and 4*b* of anterior footrest 4 can be adjustable, as can the separation of the two platforms 5*a* and 5*b* of posterior footrest 5. Intermediate horizontal platforms (not shown) can connect platforms 4*a* and 4*b* of anterior footrest 4 to corresponding platforms 5*a* and 5*b* of posterior footrest 5.

Above base 2, between anterior footrest 4 and posterior footrest 5, two lateral support legs 6 rise, respectively left and right, each lateral support leg 6 having a telescopic tubular structure.

Anterior support device 1 comprises movable assembly 7, essentially formed by upper support element 8 for the thighs and lower support element 9 for the legs, assembly 7, thus constituted, being pivotally mounted around horizontal axis A, transversely oriented, according to arrow F1, between the two lateral support legs 6.

More specifically, upper support element 8 and lower support element 9 are connected by means of a frame or by two lateral risers 10, which maintain them at a distance from one another, so that open space 11 is found between upper support element 8 and lower support element 9. Upper support element 8 substantially extends in a first transverse plane P1, and lower support element 9 substantially extends in another transverse plane P2. Lateral risers 10 are elbowed or bent in their median zone, thus, near open space 11, such that the two planes P1 and P2 together form an obtuse angle B, the value of this angle being advantageously comprised between 130° et 150°.

Assembly 7, formed by upper support element 8 and lower support element 9, is pivotally mounted around horizontal axis A by means of two lateral pivots 12, each of which connects the upper part of lateral support leg 6 to the median zone of lateral riser 10, near open space 11. Stops (not shown), which can be incorporated in the two lateral pivots 12, are provided to limit the pivoting of assembly 7 in both directions of rotation and, thus, define the extreme angular positions of this assembly 7, as specified below.

Upper support element 8 and lower support element 9 can be made of a flexible or deformable material, preferably inextensible, similar to webbing or straps, respectively stretched between the upper and lower portions of the two lateral risers 10.

Figure 3:
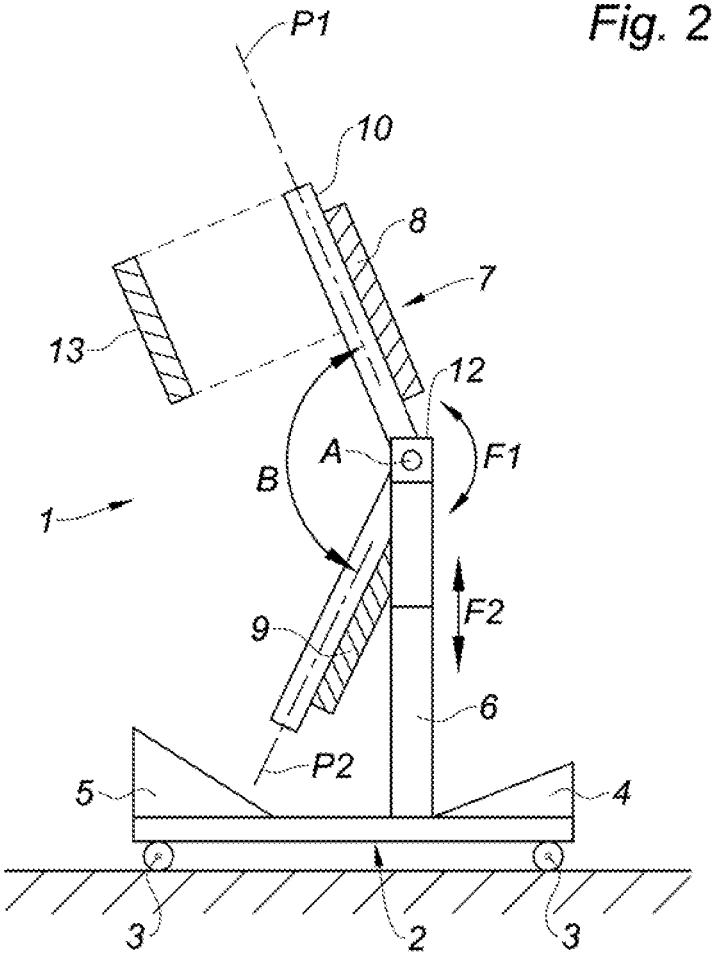
FIG. 3 is a side view of the device in intermediate or neutral position.

The apparatus also comprises additional support element 13 for the user's torso, which is here a posterior support element connected and, in particular, suspended from assembly 7. As shown in FIG. 3, additional support element 13, a type of webbing or strap and preferably of an elastic material, connects the respective upper portions of the two lateral risers 10, with the possibility of unhooking at least one side to allow access. Depending on the height, such an additional support element 13 can serve to position and support the user's upper thighs or buttocks, or even the lumbar region.

In a manner not shown, and also with respect to a posterior support element, this additional support element 13 can be separate from anterior support device 1 and be borne by a separate support structure, stationary or movable, the assembly forming a complete apparatus. If it consists of a stationary support structure, this is connected to base 2 or directly attached to the floor. If it consists, on the other hand, of a movable support structure, this is advantageously mounted on rollers so that additional support element 13 can easily be brought closer or further away from anterior support device 1.

Figure 4:
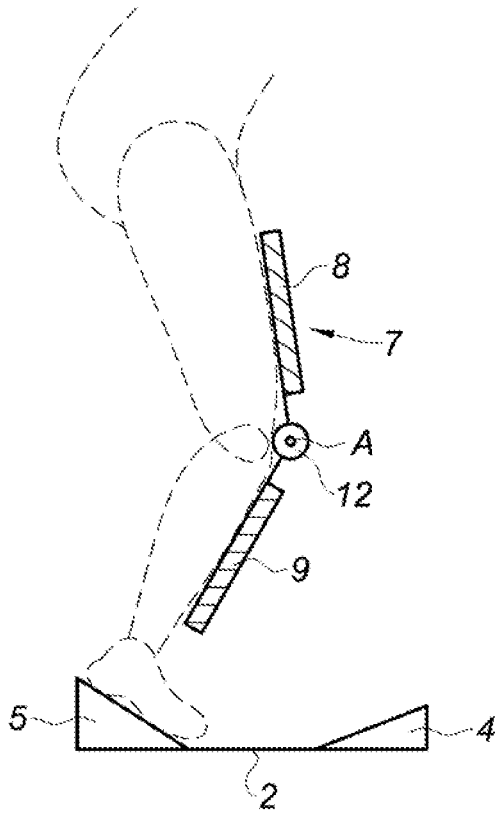
FIG. 4 is a schematic view illustrating the use of the device of the above figures in a first use position.
Figure 5:
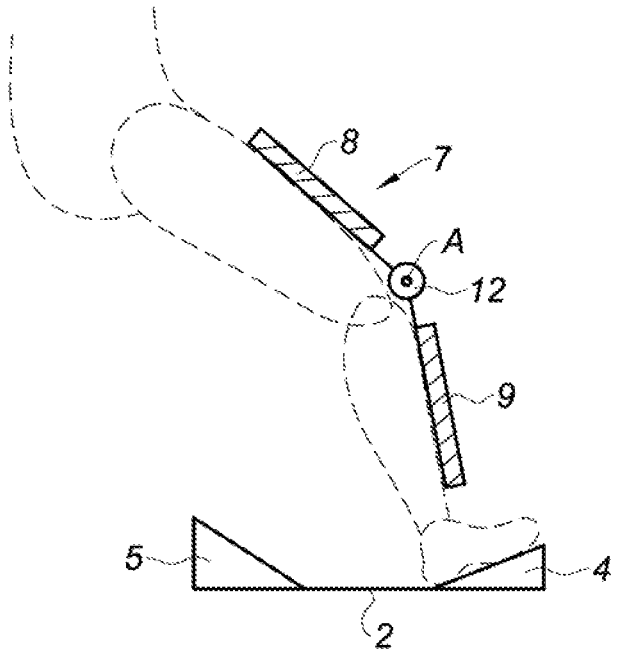
FIG. 5 is a schematic view similar to FIG. 4 but illustrating a second use position of the same device.

FIGS. 4 and 5 illustrate the use of anterior support device 1 described above, whose operation is based on the pivoting of assembly 7 around horizontal axis A, between two extreme angular positions.

In a first extreme position (FIG. 4), the user is leaning forward and presses his thighs against upright upper support element 8 and his legs against lower support element 9, obliquely directed toward the back, while his two feet press upon posterior footrest 5.

In a second extreme position (FIG. 5), the user is leaning backward and presses his thighs against upper support element 8, obliquely directed toward the back, and his legs against upright lower support element 9, while his two feet press upon anterior footrest 4.

The transition from one extreme position to another, therefore, from a first use position to a second use position, is carried out by rotating assembly 7 around horizontal axis A, along an angle of rotation that can be comprised between 20° and 45°, and, more specifically, an angle of rotation comprised between 25° and 35°, while moving through the intermediate position of FIG. 3, rotation of assembly 7 thereby accompanying the movement of the user's lower limbs. This movement, notably causing the user's feet to move from one footrest, 4 or 5, to the other, is carried out by alternatively shifting one lower limb and then the other. The stops mentioned above, which can be continuously or discontinuously adjustable, can be used to establish the two extreme positions and their angular spacing.

The intermediate position illustrated in FIG. 3, which can also be referred to as a neutral position, allows the user to easily access the apparatus from the left or right side, in particular, without being inconvenienced by lower support element 9 or by the lower portions of lateral risers 10.

The telescopic structure of the two lateral support legs 6 can be used to adjust the height of horizontal axis A and, consequently, of assembly 7, in line with arrow F2, in particular, to adjust the apparatus to the user's size and, if appropriate, to the environment, in particular, to accommodate the presence of a desk in front of the apparatus.

Optional rollers 3 facilitate the movement of the apparatus over the floor, in particular, in the forward-back direction; these rollers 3 are advantageously self-locking to ensure the stability of the apparatus, especially when transitioning from one use position to another.

Figure 6:
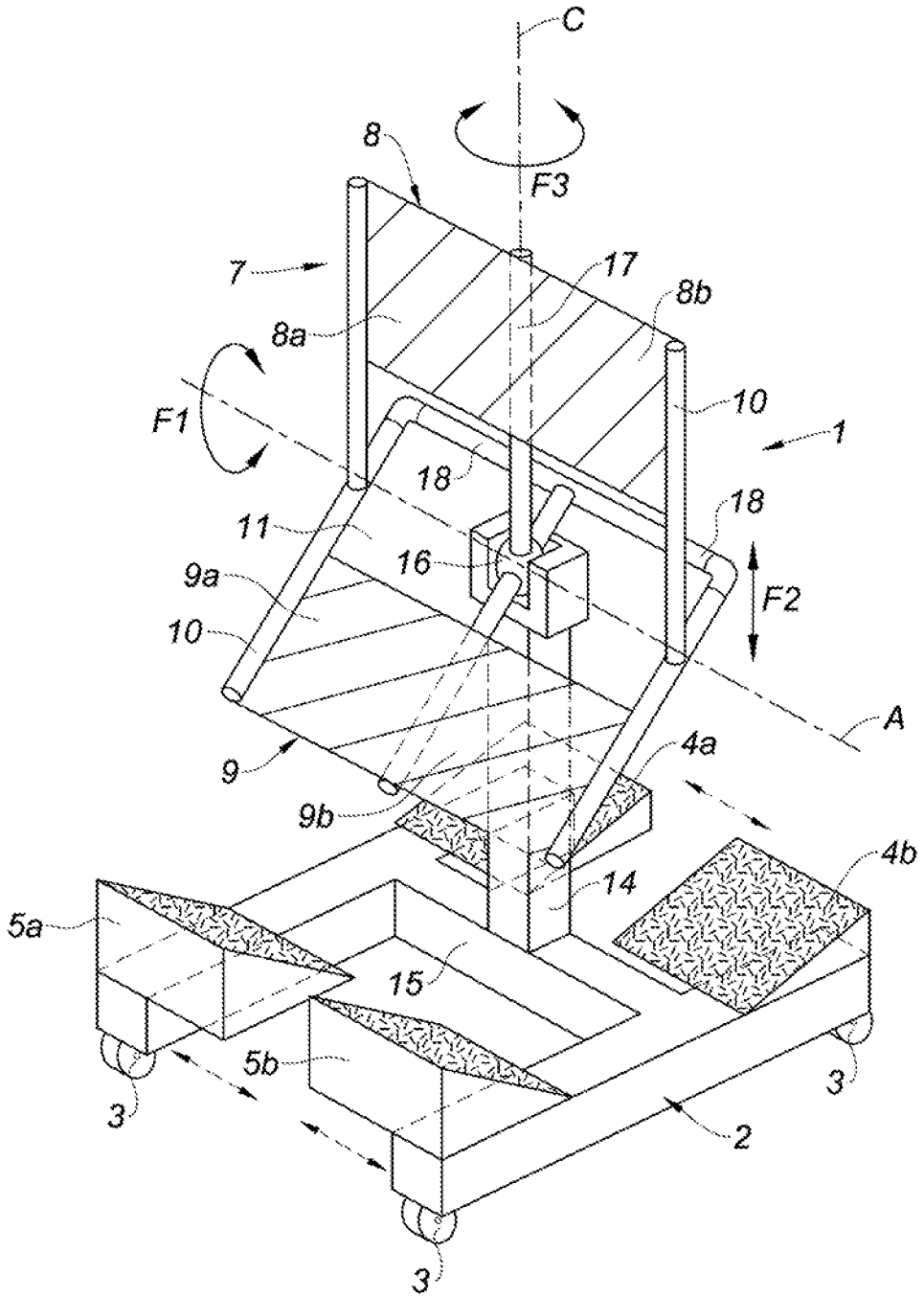
FIG. 6, a perspective view, represents a variant of the device in the preceding figures.

A variant of anterior support device 1 is shown in FIG. 6.

Base 2 here has an "H" configuration while a center support column 14, of telescopic structure, rises above center bar 15 of this base 2. Assembly 7, formed by upper support element 8 and lower support element 9, is pivotally mounted around a horizontal axis A, transversely oriented, by means of single center pivot 16, located at the top of support column 14.

Here, assembly 7 also has two lateral risers 10 as well as a double center separation bar 17, these being connected by transverse bars or arches 18. Upper support element 8 is held between the upper parts of the two lateral risers 10 and comes into contact with the upper portion of double center separation bar 17. Similarly, lower support element 9 is held between the lower parts of the two lateral risers 10 and comes into contact with the lower portion of double center separation bar 17. In this way, upper support element 8 is separated into two portions, respectively left portion 8*a* and right portion 8*b*, and, similarly, lower support element 9 is separated into two portions, respectively left portion 9*a* and right portion 9*b*, left portion 8*a* or 9*a* and right portion 8*b* or 9*b* having a certain independence, preventing the knees from slipping toward one another.

In the case of this variant, assembly 7 with support elements 8 and 9 can also be pivotally mounted around vertical axis C of support column 14, as suggested by arrow F3.

Center pivot 16 can have a yoke that serves as a stop limiting, on the one hand, the extent to which assembly 7 pivots around horizontal axis A and, on the other hand, the extent to which the same assembly 7 pivots around vertical axis C.

The specific advantages of this first embodiment and, where applicable, its variant according to FIG. 6, are:

sturdy construction, the "fluidity" of the transition from one use position to another, the self-balancing of assembly 7 formed by upper support element 8 and lower support element 9, to the extent that the horizontal pivot axis A of this assembly 7 is substantially located at the midpoint of said assembly, if assembly 7, formed by upper support element 8 and lower support element 9, is pivotally mounted between two lateral support legs 6, the center open space appearing between these support legs 6, in particular near the user's torso, facilitates the transition from one use position to another, where applicable, the possibility of additional pivoting of said assembly 7 around vertical axis C, to the extent that this assembly 7 is mounted on center support column 14, which gives the user the ability to advance one knee and draw back the other knee, thereby enabling the user to more easily turn toward one side or the other by a rotational movement of the torso.

Figure 7:
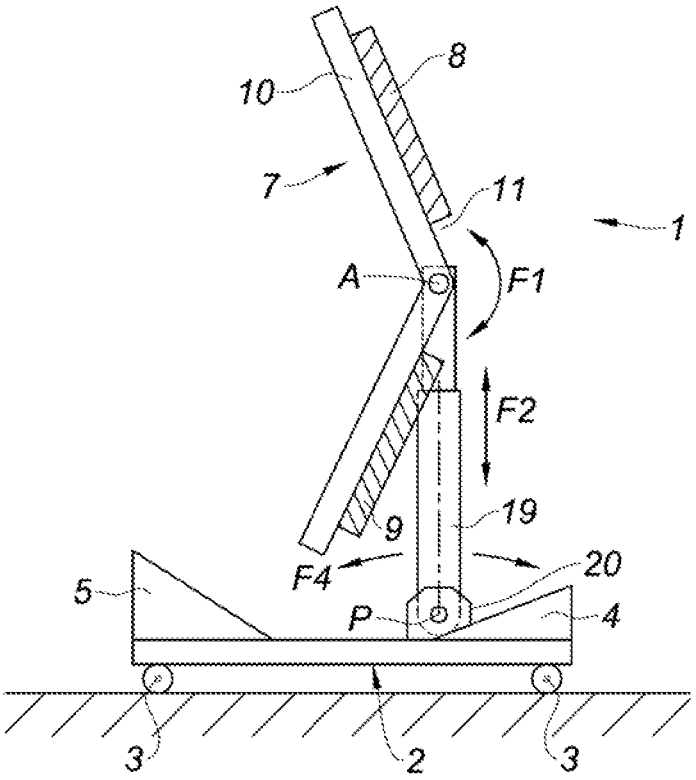
FIG. 7 is a side view of an anterior support device according to the invention, in a second embodiment.
Figure 8:
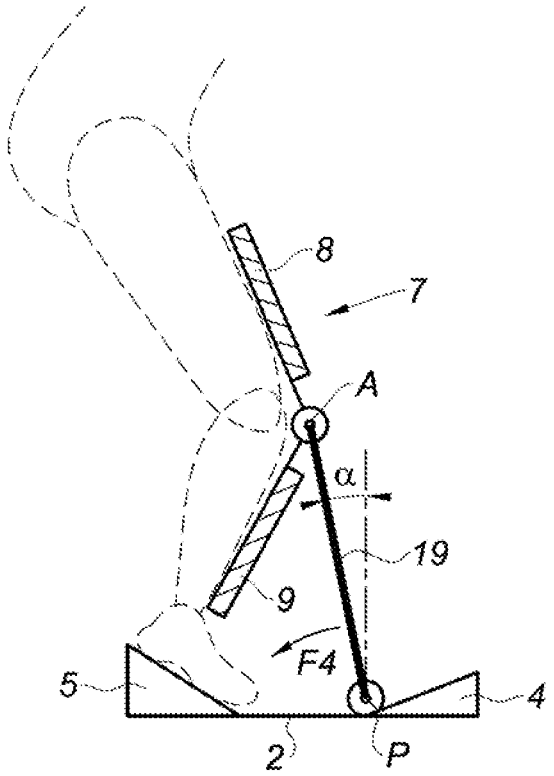
FIGS. 8 and 9 are schematic views illustrating the operation and use of the device of FIG. 7 in two distinct positions.
Figure 9:
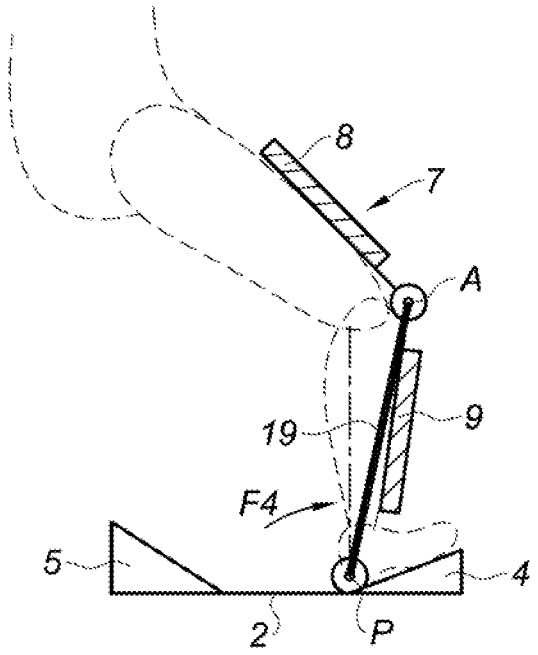

We refer now to FIGS. 7 to 9, relative to a second embodiment, wherein the elements shared with the first embodiment and, in particular, assembly 7 and its components or parts, are designated by the same identifying numbers and are not described again. In this other embodiment, the bearing structure that supports assembly 7 is a movable structure, in this case center a support arm 19 pivotally mounted on base 2 in such a way that it can move in an anteroposterior vertical plane.

More specifically, the lower extremity of support arm 19 is pivotally mounted on base 2 by means of a yoke 20, which defines horizontal pivot axis P, transversely oriented. At the upper extremity of support arm 19, assembly 7, formed by upper support element 8 for the thighs and lower support element 9 for the legs, is pivotally mounted along horizontal axis A.

Operation of this embodiment is determined by the pivoting of support arm 19, according to double arrow F4, between two extreme angular positions that can be determined by stationary or adjustable stops (not shown), combined with the pivoting of assembly 7 around horizontal axis A.

In a first extreme position (FIG. 8), the user leans forward while support arm 19 is inclined backward, forming an angle, "alpha," with the vertical. As in the first embodiment, the user presses his thighs against upper support element 8, which is almost vertical, and his legs against lower support element 9, obliquely directed backward, such that his two feet press upon posterior footrest 5.

In a second extreme position (FIG. 9), the user is leaning backward while support arm 19 is, conversely, inclined frontward. As in the first embodiment, the user presses his thighs against upper support element 8, which is directed obliquely toward the rear, and his legs against lower support element 9, which is upright, such that his two feet press upon the anterior footrest 4.

During the transition from one use position to the other, assembly 7 follows the movement of the user's lower limbs. If necessary, the pivoting of assembly 7 and support arm 19 along horizontal axes A and P, respectively, is coordinated by the action of at least one spring or by mechanical means.

The specific advantages of this second embodiment are:

its simplicity of construction, notably with respect to the number of components, its compactness, with a reduction in size in the anteroposterior direction as well as in the transverse direction, the fact that the upper portion of the device occupies a substantially invariable position in space, which maintains the user's center of gravity in a substantially constant position and also places the user's torso at a horizontal distance from the work surface that is practically constant for all postures.

Figure 10:
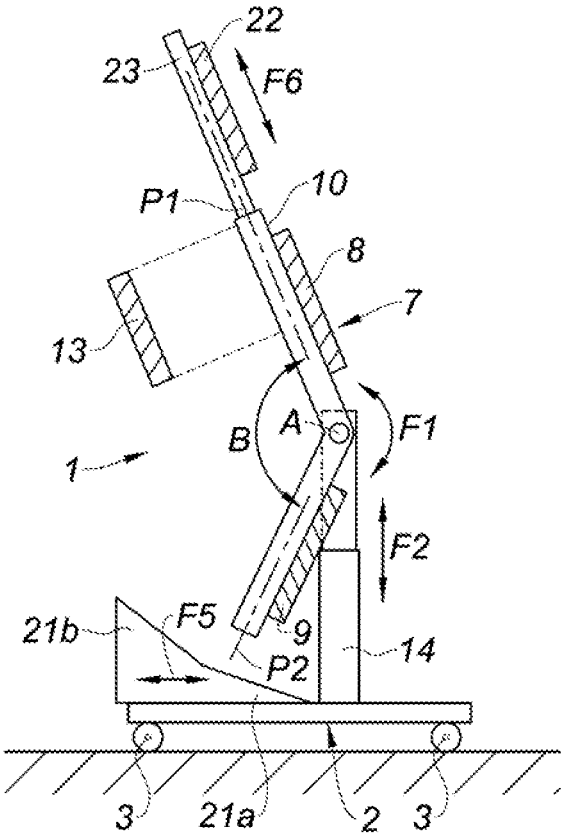
FIG. 10 is a side view of an anterior support device according to the invention, in a third embodiment.

FIG. 10 illustrates a third embodiment, distinguished from the previous embodiments by the configuration of footrest 21, which is here single. Footrest 21 has a dual slope in the sense that it has an anterior portion 21*a* with a smaller angle, for example, comprised between 5° and 15°, and a posterior portion 21*b*, with a greater angle, for example, comprised between 30° and 50°. The two portions, 21*a* and 21*b*, can be connected by a transitional portion (not shown) with an intermediate slope, of 25° for example, or with a curved profile.

Operation of this embodiment is still based on the pivoting of assembly 7 around horizontal axis A, between two extreme positions. In a first extreme position, the user is leaning forward, with his lower limbs pressed against upper and lower support elements 8 and 9, while the user's feet press against posterior portion 21*b* of footrest 21. In a second extreme position, the user is leaning backward, with the user's lower limbs still pressed against upper and lower support elements 8 and 9, while the user's feet press against anterior portion 21*a* of footrest 21.

The position of footrest 21 is advantageously adjustable in the anteroposterior direction, as shown by arrow F5, to adapt footrest 21 to user's size in a manner that is coordinated with the height adjustment of support column 14 and, consequently, of horizontal axis A, in the direction of arrow F2. As a supplement or alternative, footrest 21 can itself be mounted so that it oscillates around another transversely oriented horizontal axis (not shown) in such a way that the slopes of the various portions of this footrest vary.

As also shown in FIG. 10, the apparatus can have additional support element 22 for the user's torso, which is here an anterior support element placed above upper support element 8 for the thighs. In particular, this additional support element 22 is borne by a support frame 23, possibly removable, which is located in the upward extension of the two lateral risers 10. Additional support element 22 can be height adjustable, for example, through the telescoping action of support frame 23, as indicated by arrow F6, to better accommodate the user's size and morphology. Support frame 23 can, in its upper portion, carry additional lateral support elements (not shown) for the elbows or forearms, these latter support elements also benefiting from the height adjustability obtained by the telescoping action of support frame 23.

The specific advantages of this third embodiment are:

finer adjustment according to the length of the user's legs, pressed against the lower support element, through the longitudinally adjustable dual- or triple-slope footrest, improved comfort for the user's feet, whichever of the two portions, respectively anterior and posterior, of the footrest, they press against, in the case of the presence of an additional support element for the user's torso, preferably height adjustable, a better distribution of the support points for the user's body, especially when leaning forward.

Out of a concern for simplicity, in the previous figures the apex of obtuse angle B, formed by planes P1 and P2, has been shown as coincident with horizontal pivot axis A of assembly 7.

Figure 11:
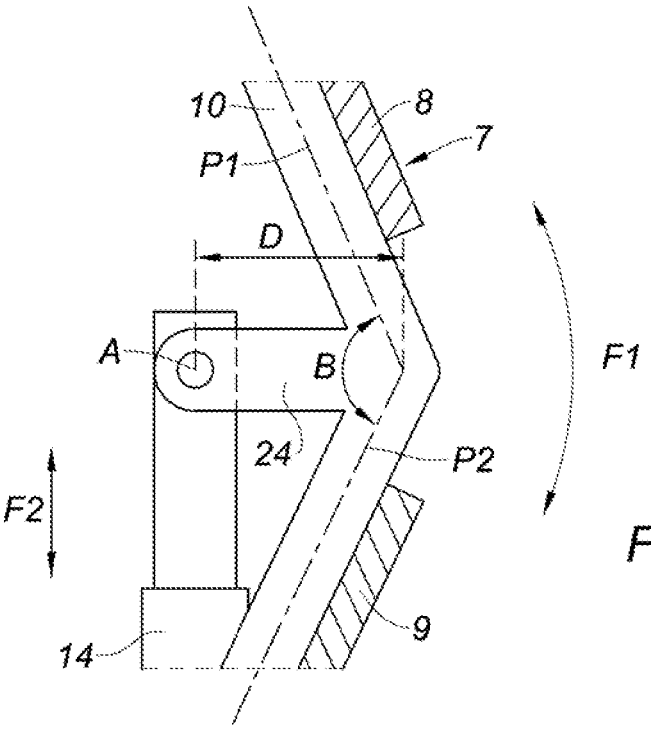
FIG. 11 is an enlarged detail of FIG. 10.

However, as shown in FIG. 11, the apex of obtuse angle B, formed by planes P1 and P2, is advantageously positioned in front of horizontal axis A, along offset D, obtained by connector arm 24, wherein offset D can be comprised between 5 cm and 30 cm.

Because of this arrangement, the trajectory of assembly 7 can be modified and improved, in particular, to optimize the transition between the two extreme positions of this assembly 7 and corresponding user postures.

Figure 12:
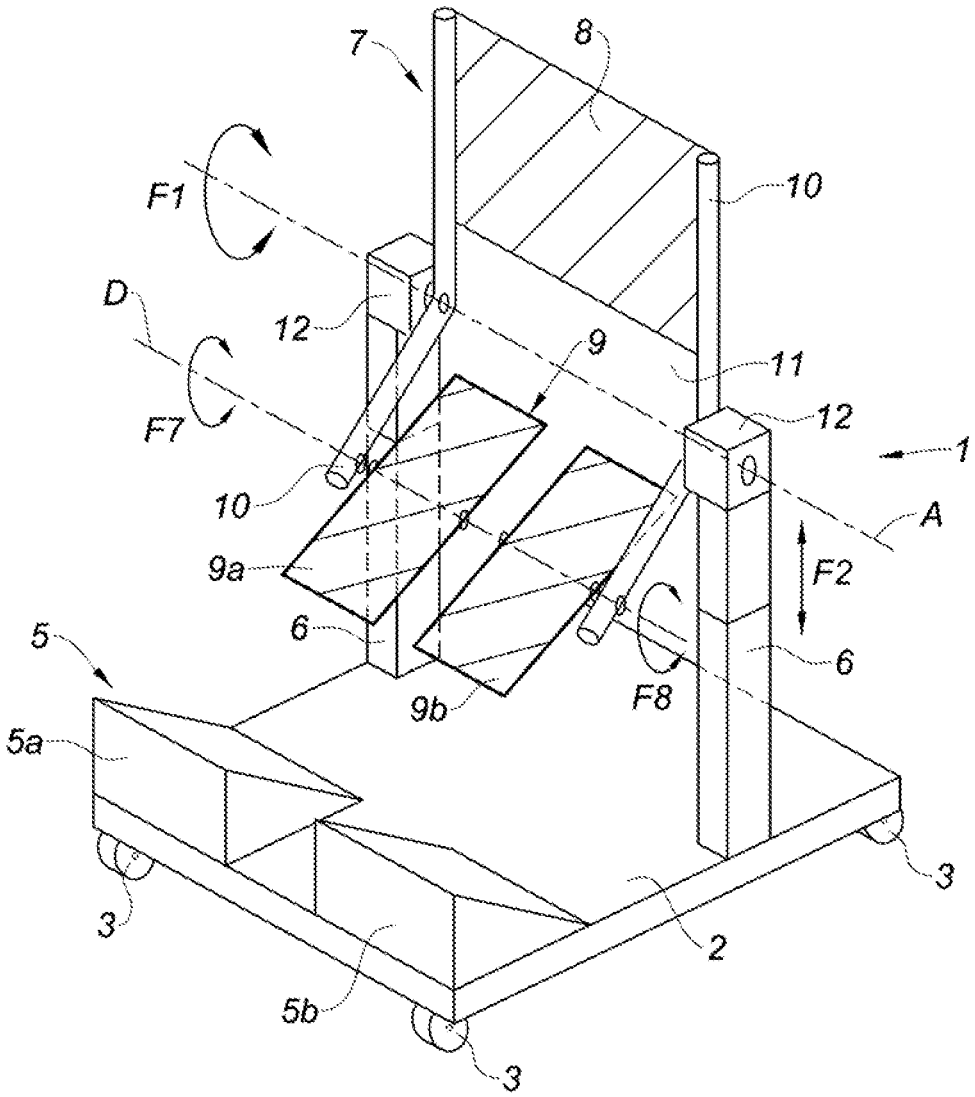
FIG. 12 is a perspective view of an anterior support device according to the invention, in a fourth embodiment.

FIG. 12 illustrates a fourth embodiment, distinguished from the previous embodiments by the construction of the assembly 7.

The assembly 7 comprises a frame including two lateral risers 10 which are pivotally mounted around a first horizontal axis A, transversely oriented, between the two lateral support legs 6, according to arrow F1. The upper support element 8 is directly attached to the two lateral risers 10. The lower support element 9 is mounted between the two lateral risers 10 so that it pivots around an additional horizontal axis D, transversely oriented and parallel to first horizontal axis A.

More particularly, the lower support element 9 has separate left portion 9*a* and right portion 9*b*, each pivotally mounted around additional horizontal axis D, as suggested by arrows F7 and F8. The additional horizontal pivot axis D is situated at an intermediate height of left portion 9*a* and right portion 9*b* of lower support element 9.

In this embodiment, the base 2 is equipped with a posterior footrest 5, consisting of a single inclined platform or of two inclined platforms 5*a* and 5*b*, respectively left and right. The remaining portion of base 2 is forming a horizontal platform.

Figure 13:
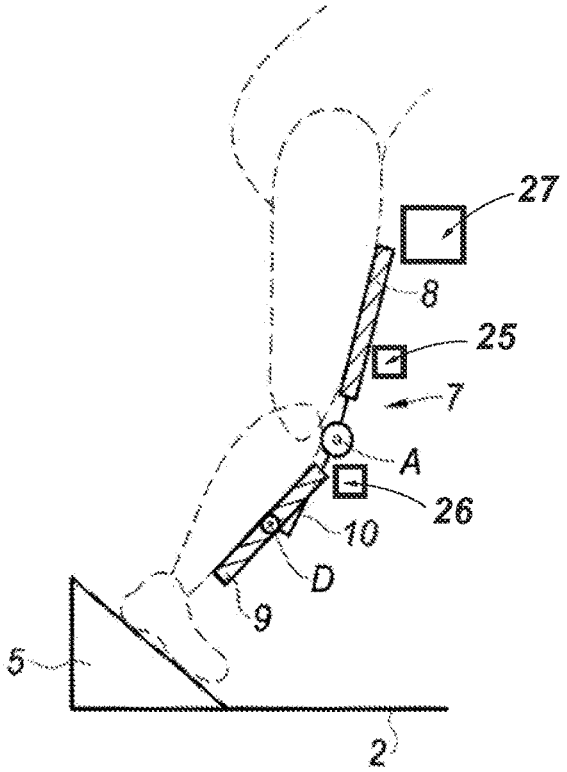
FIGS. 13 and 14 are schematic views illustrating the operation and use of the device of FIG. 12 in two distinct positions.
Figure 14:
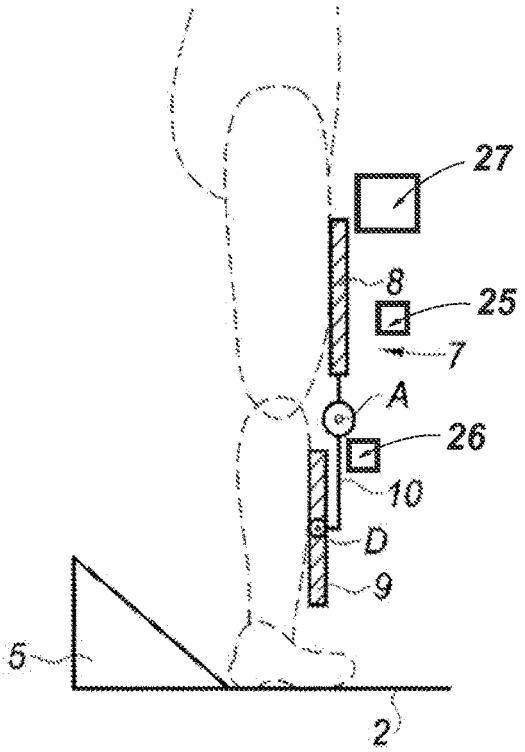

FIGS. 13 and 14 illustrate the use of the anterior support device of FIG. 12, the operation of which is based on the pivoting of the whole assembly 7 around first horizontal axis A, as described above, and further on the simultaneous pivoting of the lower support element 9 around additional horizontal axis D.

The first extreme position (FIG. 13) is a forward leaning position. The upper support element 8 is obliquely directed toward the front, forming a small angle with the vertical plane. The lower support element 9 is obliquely directed, substantially perpendicular to the inclined platform(s) of posterior footrest 5. The user is leaning forward and presses his thighs against upper support element 8 and his legs against lower support element 9, while his two feet press upon footrest 5.

The second extreme position (FIG. 14) is an upright standing position. Both support elements 8 and 9 are substantially parallel and vertically oriented. The user is standing upright on the horizontal platform of base 2 and can press his thighs against upper support element 8 and his legs against lower support element 9.

During user's transition from one extreme position to the other extreme position, for example from the forward leaning position to the upright standing position, the whole assembly 7 is pivoting along first horizontal axis A, and simultaneously left portion 9*a* and right portion 9*b* of lower support element 9 are pivoting independently from each other along additional horizontal axis D, so as to follow the movement of the user's lower limbs. During this transition, the angle formed between the upper support element 8 and the lower support element 9, and thus between the user's thighs and legs, will vary within a certain range.

Stops 25 and 26 are provided to limit the pivoting of assembly 7 in both directions of rotation and, thus, define the extreme angular positions of this assembly 7. The stops 25 and 26 may be continuously or discontinuously adjustable and can be used to establish the two extreme positions and their angular spacing. Advantageously, this device also has return means, such as a spring 27, capable of returning the assembly formed by the two support elements, respectively upper and lower, by pivoting to an intermediate or neutral position, in particular, to a position in which the assembly is approximately located in a vertical plane.

The specific advantages of this fourth embodiment are:

improved accompanying of the user's lower limbs during the transition from one use position to another, optimal adaptability to an upright standing position of user, enhanced lateral access for the user in the upright standing position.

In practical use, anterior support device 1 and the complete apparatus described above can be combined with a desk, in particular, a desk suitable for working while standing, the desk height preferably being adjustable, or combined with a specialized workstation, such as a computer or industrial workstation. The first use position provided by the device is a standing or sitting-standing position for work, leaning forward, while the second use position provided by the device is a standing or sitting-standing position for work or relaxation, leaning backward or upright standing position, the device facilitating the transition from one use position to the other while accompanying the movement of the user's lower limbs.

As shown by the above, the invention is not limited solely to embodiments of this anterior support device and body support apparatus described above as examples; on the contrary, it encompasses all the variant embodiments and applications covered by the attached claims. Thus, in particular, one would remain within the framework of the invention:

by differently combining the diverse characteristics illustrated, for example, by including two pivoting lateral support arms in the second embodiment;

by modifying the shape and construction of the support elements;

by providing, in place of the open space arranged between the upper support element and the lower support element, one or more recesses or openings capable of accommodating the user's knees;

by eliminating any open space or recess between the upper support element and the lower support element, in which case both support elements are directly connected and can be realized in one piece;

by articulating the assembly formed by the upper support element and the lower support element around a horizontally pivoting axis placed differently, in particular, an axis located at an intermediate height of the upper support element or near the apex of this upper support element;

by shifting the lateral support legs of the first embodiment to the front or back;

starting from the second embodiment, by providing a different type of movement, that is, in translation rather than in rotation, for the movable bearing structure on which is pivotally mounted the assembly formed by the upper and lower support elements;

more generally, by providing any shape or construction to said bearing structure, whether it is stationary or movable;

starting from the fourth embodiment, by mounting the upper support element, instead of or in addition to the lower support element, around an additional horizontal pivot axis;

by giving the footrest platforms any suitable shape, for example, by combining the left and right platforms to form a single platform extending throughout the width of the base, and by forming those platforms using any process, especially by molding them directly with the base;

by providing, beneath this base, a different number of rollers or by realizing a base without rollers;

by providing other additional support elements, such as elements for the elbows or forearms, or even for the back, similar to a seat back, wherein these additional support elements can be supported by any means, in particular, by lateral support legs that can be extended upward;

by adding various accessories capable of improving the use of the device, in particular, handgrips enabling the user to hold on when entering the device or adjusting its height, or even a step or footwell facilitating user access to the footrest(s);

by realizing the pivot limit stop or stops in any shape and by any means, for example, by simple contact with the edge of a desk or other work surface;

by replacing the pivot or pivots by any means for equivalently realizing a rotational guide, for example, curved tracks that cooperate with pulleys;

by designing the bearing structure not as an autonomous structure resting on the floor but as a structure integrated with a desk or other workstation.

The invention claimed is:

1. An anterior support device for supporting lower limbs of a user during a standing position and enabling the user to change positions; said device comprising:

an upper support element for supporting a front of thighs, substantially extending in a transverse plane, a lower support element for supporting a front of legs or tibias, substantially extending in a transverse plane, at least one open space or recess between the upper support element and the lower support element to accommodate the user's knees, the upper support element and the lower support element being connected by two lateral risers, wherein an assembly formed by the upper support element and the lower support element is mounted so that it pivots on a bearing structure around a transversely oriented horizontal pivot axis situated near the open space or recess present between the upper support element and the lower support element; and wherein rotation of said assembly around the horizontal pivot axis enables the upper support element and the lower support element to accompany the lower limbs of the user during the user's transition from one use position to another use position.

2. The anterior support device according to claim 1, wherein an obtuse angle is formed between the plane of the upper support element and the plane of the lower support element, said obtuse angle having a fixed value or an adjustable value.

3. The anterior support device according to claim 2, wherein the obtuse angle, formed between the plane of the upper support element and the plane of the lower support element, has a value between 130° and 150°.

4. The anterior support device according to claim 2, wherein the apex of the obtuse angle, formed between the plane of the upper support element and the plane of the lower support element, is situated in front of the horizontal pivot axis.

5. The anterior support device according to claim 1, wherein in said assembly the lower support element is pivotally mounted, between the two lateral risers, around an additional transversely oriented horizontal pivot axis situated at an intermediate height of said lower support element, and wherein, when the user transits from one use position to another use position, rotation of the lower support element around the additional transversely oriented horizontal pivot axis relative to the upper support element, in combination with rotation of said assembly around its own horizontal pivot axis, enables the upper support element and the lower support element to accompany the lower limbs of the user.

6. The anterior support device according to claim 1, wherein the lateral risers are elbowed or bent in their median zone near said open space.

7. The anterior support device according to claim 1, comprising one or more stops capable of limiting a pivoting movement of the assembly formed by the upper support element and the lower support element.

8. The anterior support device according to claim 1, comprising a return means capable of pivotally moving the assembly formed by the upper support element and the lower support element, back to an intermediate or neutral position, the intermediate or neutral position being a position in which said assembly is substantially located in a vertical plane.

9. The anterior support device according to claim 1, wherein the assembly formed by the upper support element and the lower support element is pivotally mounted on a movable bearing structure, said movable bearing structure including a pivoting structure having at least one articulation along a transversely oriented horizontal axis.

10. The anterior support device according to claim 1, wherein the upper support element and the lower support element are made of at least one of a semi-rigid material and a flexible or deformable material; wherein the flexible or deformable material is configured in a manner of webbing or straps.

11. The anterior support device according to claim 1, wherein one or both of the upper support element and the lower support element are adapted to support corresponding portions of both of left lower limb and right lower limb of the user.

12. The anterior support device according to claim 1, wherein one or both of the upper support element and the lower support element have a separate left portion and right portion, respectively to support corresponding portions of left lower limb and right lower limb of the user.

13. An apparatus for supporting body of a user in a standing position, said apparatus comprising:

an anterior support device for lower limbs, comprising an upper support element for supporting a front of thighs; a lower support element for supporting a front of legs or tibias, the upper support element and the lower support element being connected by two lateral risers; and a bearing structure having a base equipped with at least one footrest;

wherein an assembly formed by the upper support element and the lower support element is mounted so that it pivots on the bearing structure around a transversely oriented horizontal pivot axis situated near an open space or recess existing between the upper support element and the lower support element.

14. The apparatus according to claim 13, wherein the assembly formed by the upper support element and the lower support element of the anterior support device for the lower limbs is pivotally mounted between two lateral support legs rising above said base.

15. The apparatus according to claim 14, wherein the assembly formed by the upper support element and the lower support element of the anterior support device for the lower limbs is pivotally mounted around its horizontal pivot axis by means of two lateral pivots, each of which connects an upper part of one of said lateral support legs to a median zone of one of said lateral risers, near said open space.

16. The apparatus according to claim 13, wherein said at least one footrest has at least one portion having a slope associated with at least one use position.

17. The apparatus according to claim 13, comprising at least one of an anterior support element and a posterior support element for supporting a torso of the user.

18. The apparatus according to claim 17, wherein the posterior support element for supporting the user's torso is suspended from an upper portion of the assembly formed by the upper support element and the lower support element of the anterior support device for the lower limbs.

19. The apparatus according to claim 17, wherein the anterior support element for supporting the user's torso is borne by the assembly formed by the upper support element and the lower support element of the anterior support device for the lower limbs, and wherein said anterior support element is located in an upward extension of the upper support element for the thighs.

20. The apparatus according to claim 13, wherein in said assembly the lower support element is pivotally mounted, between the two lateral risers, around an additional transversely oriented horizontal pivot axis situated at an intermediate height of said lower support element.

21. The apparatus according to claim 13, wherein one or both of the upper support element and the lower support element are adapted to support corresponding portions of both of left lower limb and right lower limb of the user.

22. The apparatus according to claim 13, wherein the assembly formed by the upper support element and the lower support element of the anterior support device for the lower limbs is mounted on a center support column rising above a base having the at least one footrest, wherein said assembly is pivotally mounted around a vertical axis of the center support column.

23. The apparatus according to claim 13, wherein the at least one footrest includes an anterior footrest and a posterior footrest, the anterior footrest and the posterior footrest having opposite slopes, wherein the anterior footrest and the posterior footrest are respectively associated with two different use positions.

24. The apparatus according to claim 13, wherein one or both of the upper support element and the lower support element have a separate left portion and right portion, respectively adapted to support corresponding portions of left lower limb and right lower limb of the user.

25. The apparatus according to claim 13, wherein the apparatus is adapted for use in association with any of a desk and a workstation, the workstation being any of a computer workstation and an industrial workstation; and wherein the apparatus, in a first use position, supports the user in a forward leaning standing position, and in a second use position, supports the user in a backward leaning standing position, or an upright standing position.

26. The apparatus according to claim 13, comprising one or more stops capable of limiting a pivoting movement of the assembly formed by the upper support element and the lower support element.

27. The apparatus according to claim 13, comprising a return means capable of pivotally moving the assembly formed by the upper support element and the lower support element, back to an intermediate or neutral position, the intermediate or neutral position being a position in which said assembly is substantially located in a vertical plane.

* * * * *